United States Patent [19]

Narasimhan

[11] Patent Number: 4,562,400

[45] Date of Patent: Dec. 31, 1985

[54] TEMPERATURE-COMPENSATED ZENER VOLTAGE REFERENCE

[75] Inventor: Tanjore R. Narasimhan, Salem, N.H.

[73] Assignee: Analog Devices, Incorporated, Norwood, Mass.

[21] Appl. No.: 527,749

[22] Filed: Aug. 30, 1983

[51] Int. Cl.[4] ..... G05F 5/00

[52] U.S. Cl. ..... 323/281; 323/907; 323/231

[58] Field of Search ..... 323/231, 234, 281, 907

[56] References Cited

U.S. PATENT DOCUMENTS

| | | | |
|---|---|---|---|
| 3,916,508 | 11/1975 | Conzelmann et al. | 323/907 |
| 4,352,053 | 9/1982 | Oguchi et al. | 323/907 |
| 4,398,142 | 8/1983 | Beasom | 323/231 |

*Primary Examiner*—Peter S. Wong
*Assistant Examiner*—Anita M. Ault
*Attorney, Agent, or Firm*—Parmelee, Bollinger & Bramblett

[57] ABSTRACT

A precision voltage reference comprising an IC chip having a Zener diode connected to the input of an operational amplifier. Variations in output with temperature are minimized by selectively controlling the Zener current in accordance with temperature. The current is controlled by a resistive circuit including a thermistor connected in parallel with the Zener. A method of trimming the voltage reference is provided wherein an optimum quiescent operating current is determined based on voltage and current measurements at two different temperatures.

18 Claims, 7 Drawing Figures

18
OUT SENSE
16
V+
12 (1.5K)
14 (9.2K)
26 (10K)
36 (6.3K)
24
22
38 (6.3K)
28
(1K)
Vo (10V)
20
T.P.
46 (4.7K)
44 ZENER
42
30 (10K)
40
60
48 (400)
50 (493)
10
THERMISTOR (NTC)
GND FORCE
34
GND SENSE

-55°C
-25°C
25°C
85°C
100°C
900
INITIAL OPERATING CURRENT
FINAL OPERATING CURRENT
P1
e0
ΔIC
P2
Q
54
ΔIH
IZ mAMP.
THESE CURVES WILL SHIFT UP OR DOWN FOR DIFFERENT ZENERS
6.3
6.35
6.4
VZ

TEMPERATURE-COMPENSATED ZENER VOLTAGE REFERENCE

BACKGROUND OF THE INVENTION

1. Field of the Invention

This invention relates to precision voltage references for producing a fixed d-c output voltage. More particularly, this invention relates to such a reference formed on an IC chip and providing an output voltage which is compensated for changes in ambient temperature.

2. Description of the Prior Art

A wide variety of devices and techniques have been used for developing reference voltages. One of the most common elements employed for that purpose is the well-known Zener diode which has the property of producing a substantially constant voltage when connected with a reverse-polarity supply voltage. It is known, however, that the Zener voltage varies with changes in temperature. Although such changes are relatively small, they are nevertheless significant where precision applications are involved. In addition, further small errors are introduced by the temperature sensitivity of conventional circuitry such as amplifiers and gain resistors used with Zener diodes to produce a suitable output voltage.

One technique for minimizing the Zener voltage variations with temperature is to operate the Zener at a current where its temperature coefficient (TC) is at a minimum. This however does not provide good stability over a wide range of temperatures. Zener output characteristics are non-linear with temperature, and operating at the minimum TC does not account for such non-linearities. Another approach to the problem is to use an on-chip temperature stabilizer to hold the chip temperature at a pre-set value, such as 90° C. This is unsatisfactory due to excessive power consumption and also because of unreliability and inaccuracy beyond the pre-set temperature value. Accordingly, there has developed a strong need for a precision reference which avoids the problems presented by prior art devices.

SUMMARY OF THE INVENTION

In a preferred embodiment of the present invention to be described hereinbelow in detail, a precision IC Zener voltage reference is provided wherein a temperature-sensitive resistor automatically controls the current through the Zener diode according to the ambient temperature of the chip. The variation in Zener current is selectively controlled so as to substantially nullify the normally-present effects of temperature on the reference output voltage. In accordance with another aspect of the invention, a method of trimming the current-controlling circuitry is provided for determining the optimum room-temperature operating current for each individual Zener diode.

Accordingly, it is an object of the present invention to provide a precision voltage reference characterized by good output stability over an extended temperature range. Another object of the invention is to provide such a voltage reference which has low power consumption, and that can be manufactured economically. Still other objects, aspects and advantages of the invention will in part be pointed out in, and in part apparent from, the following description of a preferred embodiment of the invention, considered together with the accompanying drawings.

DESCRIPTION OF THE PREFERRED EMBODIMENTS

Figure 1:
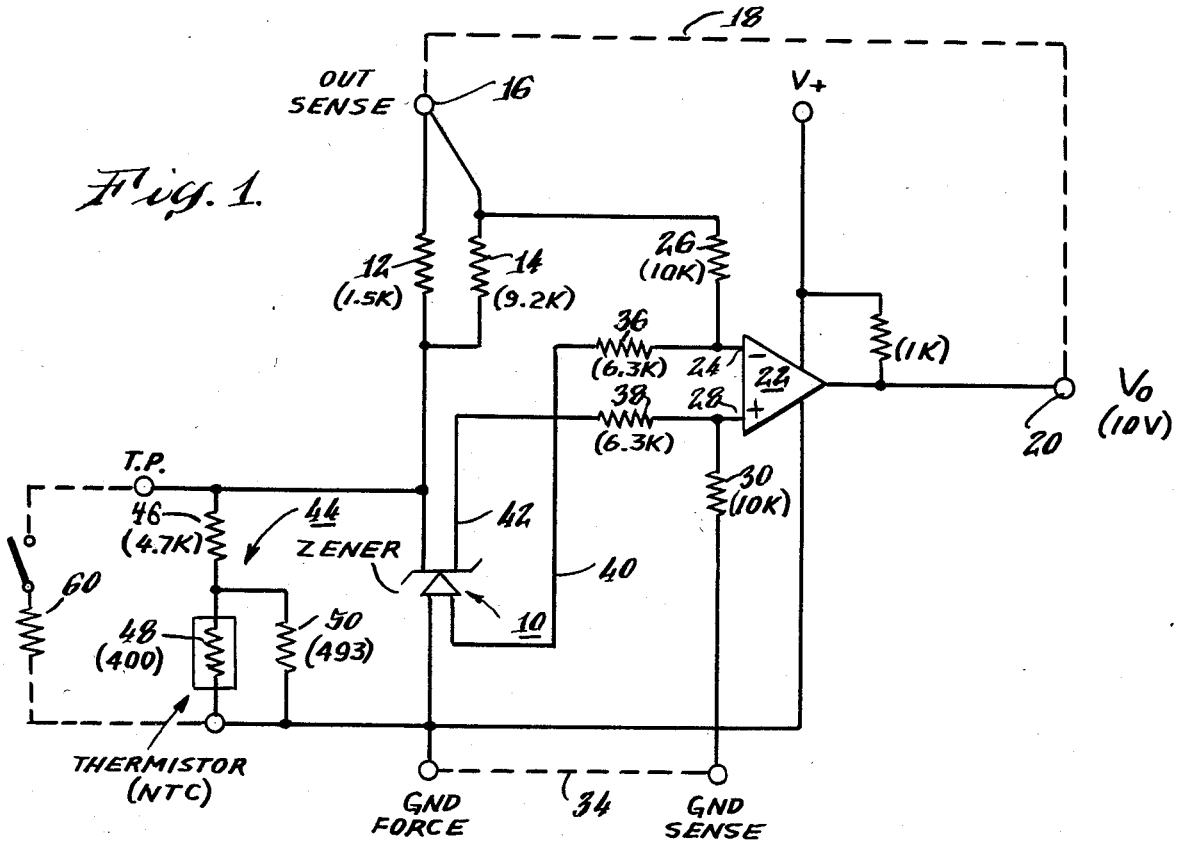
FIG. 1 is a circuit diagram showing a preferred embodiment of the invention.

Referring now to FIG. 1, the presently preferred precision voltage reference comprises a Zener diode 10 supplied with current through paralleled resistors 12, 14 connected to an "output sense" terminal 16. This terminal typically will be connected (as shown by the interrupted line 18) to the output terminal 20 of the voltage reference. In the present embodiment, the output level $V_0$ is set at 10 volts, supplied by an operational amplifier 22.

The negative input terminal 24 of the op amp 22 is connected through the usual feedback resistor 26 to the output sense terminal 16. The positive input terminal 28 is connected through a resistor 30 to a "ground sense" terminal 32 (typically grounded, as shown by the interrupted line 34). The amplifier input terminals also are connected through respective matched input resistors 36, 38 to the output leads 40, 42 of the Zener diode 10.

Since the voltage across the Zener diode 10 is substantially constant, and since the voltage at the output sense terminal 16 is substantially constant, it will be seen that the current flowing through the paralleled resistors 12, 14 will also be constant (for a given value of resistance). That is, the two paralleled resistors 12, 14 provide a constant current source. However, as will be explained, the amount of this current delivered to the Zener diode is controlled in accordance with the ambient temperature of the reference.

To control the current flowing through the Zener diode 10, a resistive circuit generally indicated at 44 is connected across the diode current terminals, i.e. in parallel with the diode. This resistive circuit includes a fixed resistor 46 connected in series with a thermistor 48, having a negative temperature coefficient (NTC). A third resistor 50 is connected in parallel with the thermistor. Thus, if for example the temperature increases, the resistance of the thermistor will decrease so as to take more of the constant current delivered by the resistors 12, 14, thereby reducing the current flowing through the Zener.

Figure 2:
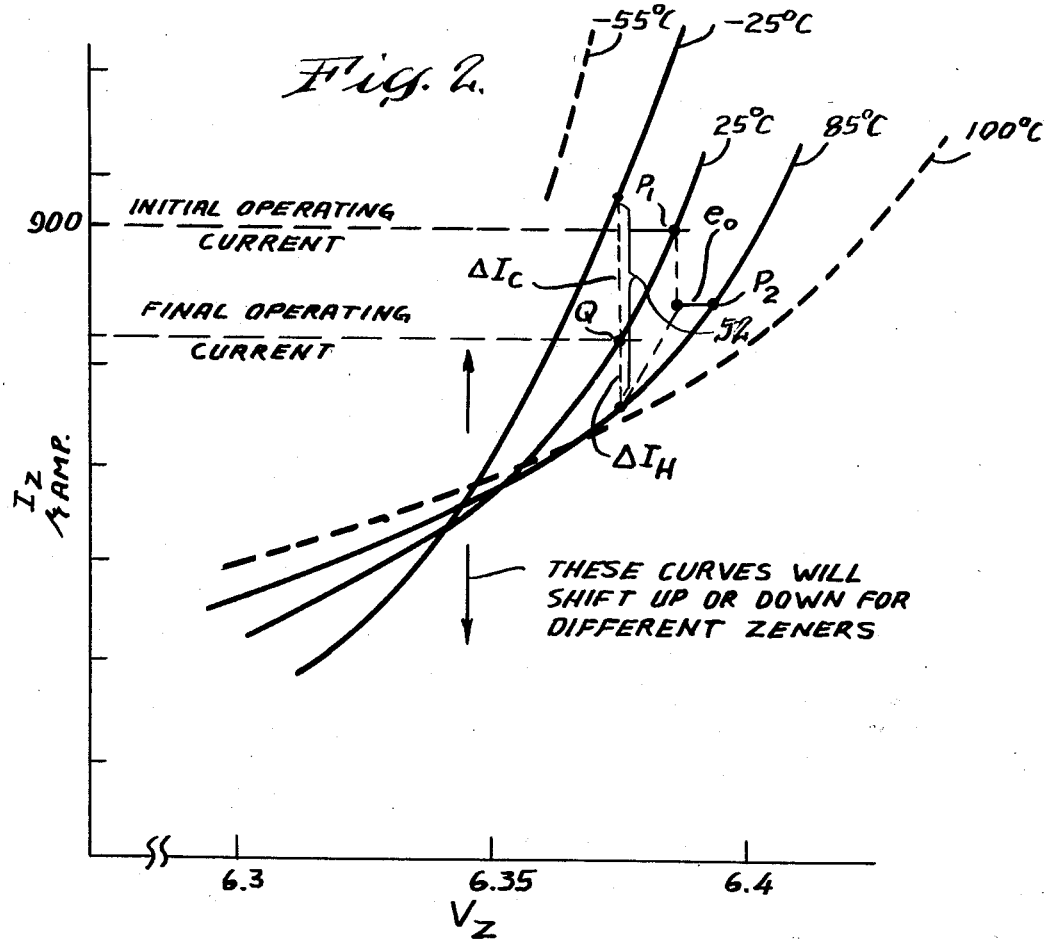
FIG. 2 is a graph presenting curves illustrating typical Zener voltage-vs-current characteristics at different temperatures.

The amount of current change produced by the thermistor 48 is selectively controlled to maintain the output $V_0$ essentially constant with changes in temperature. The relationship involved can be understood by reference to FIG. 2. Thus it will be seen that the Zener voltage-vs-current characteristics comprise a family of non-linear curves for respective temperatures. (Note:

The FIG. 2 curves are intended only to emphasize the relationships involved, and are not drawn to scale.)

The curves of FIG. 2 do not intersect at a common point, so it is not possible to provide a constant Zener voltage-vs-temperature characteristic at any fixed Zener current. Moreover, the variation of Zener voltage with temperature, for a fixed current, is quite nonlinear. This is illustrated by curve A in FIG. 5, which shows a varying positive slope through the lower-temperature portions of the range, and a varying negative slope through the higher-temperature portions.

More specifically, and returning now to FIG. 2, the Zener current is controlled so as to operate along a vertical line such as illustrated by the reference number 52. This vertical line intersects the 25° C. (room temperature) curve at a selected Zener quiescent operating point Q. If the temperature increases, the Zener current will decrease as indicated by $\Delta I_H$, representing an excursion downwardly along the vertical line 52, e.g. to the 85° C. curve. Similarly, if the temperature decreases, the current will increase as indicated by $\Delta I_C$ in an excursion upwardly along the vertical line 52. In both cases, since the excursions are along a vertical line, the Zener voltage $V_Z$ will be unchanged.

It is in the nature of Zener diodes that the FIG. 2 family of curves defining temperature behavior will differ from unit to unit. Primarily, this effect is evidenced by a shifting up or down of the entire family of curves for different Zeners, although there will be other variations as well, such as angular rotation of the curves. Because of such variations from unit to unit, it is not possible to provide a compensation circuit with pre-fixed parameters which will perfectly suit all Zeners. However, the relationship among the curves for different temperatures is in general conformance for all Zeners manufactured under controlled process conditions. This is particularly true if the Zeners are preselected for (1) operation over a given current range (e.g. 400 to 700 μamps), (2) converging curves at different temperatures, i.e. with intersection points as in FIG. 2, (3) a voltage-vs-temperature characteristic which changes from a positive slope at lower temperatures to a negative slope at higher temperatures, and (4) a temperature response of less than 10 PPM/°C. Such preselection of groups of Zeners can readily be made by IC manufacturers. Based upon recognition of such general conformance of the temperature characteristics, it has been found to be possible to provide a relatively simple technique for trimming each Zener for highly precise performance over a wide range of temperatures.

In more detail, and with continued reference to FIG. 2, the Zener circuit is initially set to provide an operating current higher than the normal operating range. For example, if a group of Zeners has a specified operating range of 400 to 700 μamps, the initial operating current may be set at 900 μamps. That current level intersects the 25° C. curve at point $P_1$. The temperature of the IC chip then is raised, as by placing the chip in an oven at, say, 85° C. It will be found that the Zener current will have decreased (due to the thermistor 48) to a level which illustratively intersects the 85° C. curve at a second point $P_2$. This will produce a change in Zener output voltage, resulting in an error represented by the horizontal line segment $e_o$.

Figure 5:
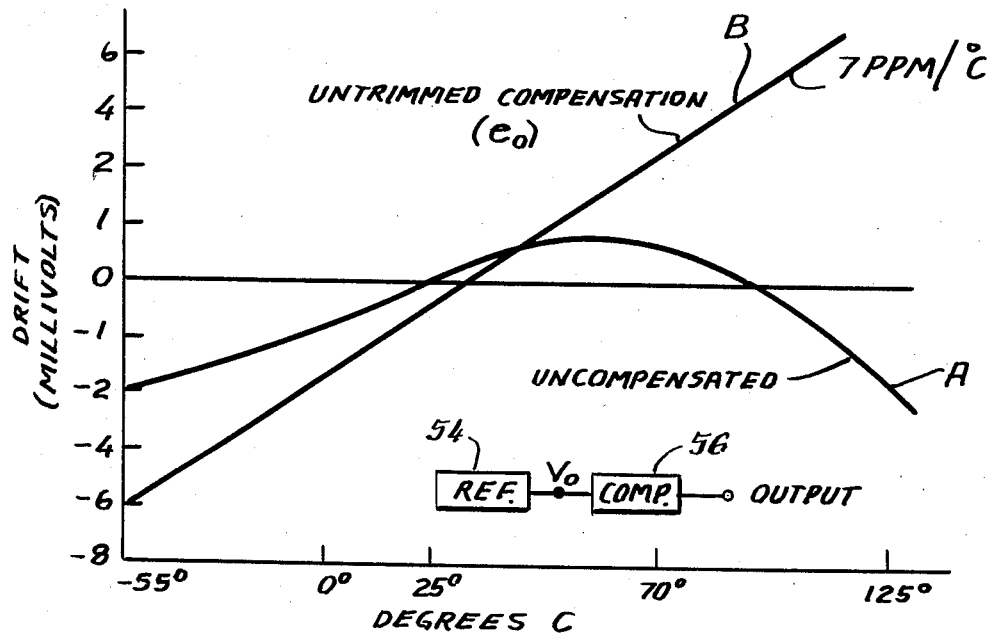
FIG. 5 is a graph showing a typical uncorrected Zener drift, and also showing the linearizing effect achievable by controlling the current through the Zener diode as a function of temperature.

If the output of the microcircuit of FIG. 1 now is measured over a wide temperature range, it will be found that the error function is approximately linear, as illustrated by curve B in FIG. 5. It may be observed that such a linear error function can if desired be corrected by known techniques based on linear TC resistors and the like, as indicated by the block diagram on FIG. 5 wherein the output $V_0$ of the IC voltage reference chip 54 is directed to a conventional linear compensation circuit 56 which produces a substantially stablized output voltage. If this technique is used, the quiescent operating current for the Zener may with advantage be set at a value providing a drift characteristic which is best suited to the particular compensation arrangement being used.

Preferably, however, the initial error factor ($e_o$) is corrected by trimming a resistor of the microcircuit at the time of manufacture to eliminate the linear component of curve B. It has been found that this result can be achieved by adjusting the quiescent Zener operating current to a final value which optimizes the performance of the voltage reference.

To that end, further voltage measurements are made of the microcircuit output after the Zener current has been perturbed by a small amount from its initial level (e.g. 900 μamps) at room temperature (25° C.), and from the normal current at the higher temperature (e.g. 85° C.). This current perturbation may for example consist of a reduction of 100 μamps in current through the Zener diode, at both temperatures. This current reduction may for example be produced by a switch-controlled resistor 60 connected in parallel with the Zener diode (but external to the IC chip). From these additional measurements, the slopes of the curves at $P_1$ and $P_2$ can readily be determined.

Figure 3:
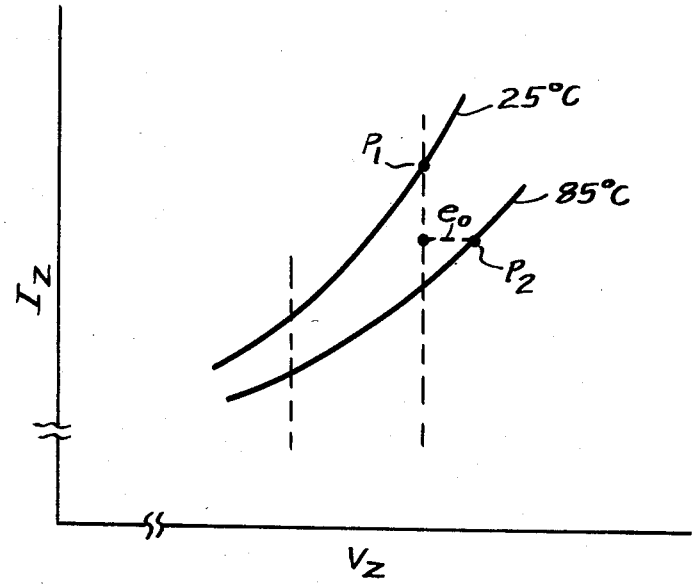
FIGS. 3 and 4 are graphs based on FIG. 2, to aid in explaining the method of determining the optimum operating current.
Figure 4:
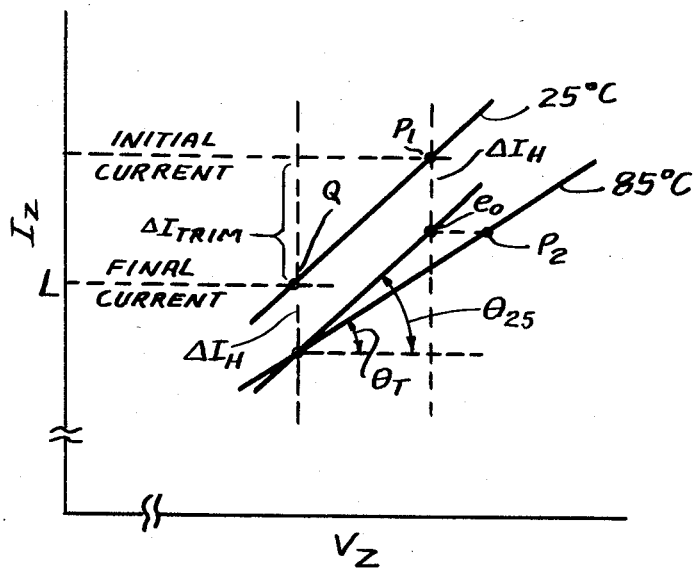

Referring now also to FIGS. 3 and 4 (which correspond to a limited portion of FIG. 2) the measured points $P_1$ and $P_2$ and the respective slope determinations at those points can be used to construct a straight-line approximation of the 25° C. and 85° C. curves as shown in FIG. 4. It will be seen that a parallelogram may be developed having two vertical sides both equal to $\Delta I_H$ as previously determined. The length of the other parallel sides of the parallelogram is determined by the intersection point of the 85° C. line and the lower parallelogram side. By this means, a new operating current level L can be determined where the previously measured excursion $\Delta I_H$ will just reach the 85° C. line, i.e. without producing any voltage error component $e_o$.

In more detail, mathematical analysis of the straight-line approximation of the curves (FIG. 4), using conventional geometrical relationships, reveals that the required change in operating current, $\Delta I_{TRIM}$, to reach the new operating current level, is equal to $e_o/(r_T-r_{25})$, where:

$e_o$=error voltage measured with initial circuit parameters $r_{25}$=dynamic resistance at room temperature (=cotangent $\theta_{25}$)

$r_T$=dynamic resistance at the high temperature (=cotangent $\theta_T$)

Thus, it will be seen that the change in Zener current to reach optimum performance is determined as a ratio of (1) the error voltage of the Zener, and (2) the difference in the dynamic driving point (or transfer) impedances, based on measurements at two temperatures. Once that determination is made, the current through the Zener diode 10 is correspondingly altered by trimming the resistor 12, in accordance with known manufacturing techniques, to provide operation at the optimum operating point Q.

It will be noted that this optimization of the Zener operating current provides specific measured compensation only for a change from room temperature to the selected elevated temperature, e.g. 85° C. However, because the families of Zener curves have general conformance for all units of the group, it is possible to pre-determine the parameters of the compensation circuit 44 so as to provide proper compensation at other temperatures. A convenient way to do this is to select a cold temperature, such as −25° C., and to determine through study of the various families of curves for the particular Zener type involved, the typical ratio between: (1) the shift in current ($\Delta I_C$) that should occur at the selected cold temperature to prevent change of the reference output, and (2) the measured shift in operating current ($\Delta I_H$) that does occur at the higher temperature to prevent change of the reference output. This ratio of $\Delta I_C/\Delta I_H$ (referred to as "k") can for practical purposes be considered to be a constant for the selected group of Zeners.

Once the ratio has been determined, conventional circuit analysis can be employed to determine appropriate parameters for the components of the resistive circuit 44 to produce the desired results. The component values shown in FIG. 1 have been found to be quite effective in producing good results for Zeners having an operating current in the range of 400 to 700 μamps.

Figure 6:
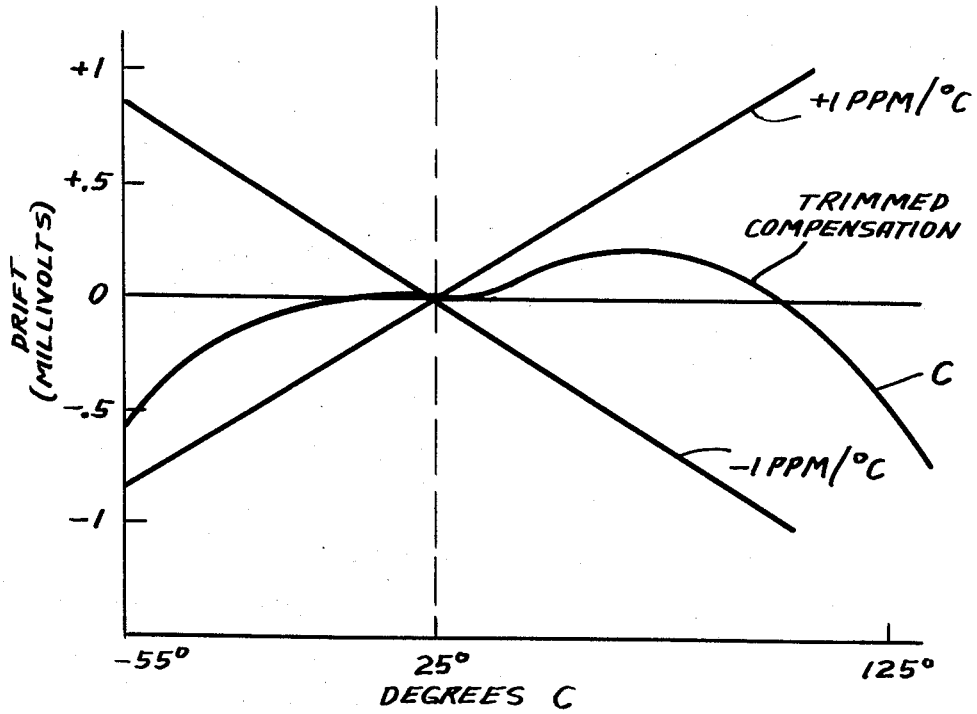
FIG. 6 is a graph showing the temperature stabilization achieved at the optimum operating point.

Although this method provides for calculated compensation at only two non-room temperatures (e.g. −25° C. and 85° C.), it has been found that the compensation actually is highly effective over a wide temperature range. Curve C of FIG. 6 illustrates the overall results that may be achieved. This curve indicates that the temperature-induced variation in output remains well within ±1 to 2 PPM/°C. (parts per million per degree C.).

It will be understood that the trim procedure described above is a predictive technique wherein a calculation based on selected measurements is made to determine the optimum Zener operating current, and a resistor in the circuit is altered so as to produce such calculated current. An alternative approach, in some cases more practical for volume production, would be to connect a progammable current sink to the circuit test point and to draw off current from the Zener diode in a pre-determined step-wise fashion, making measurements of the actual error ($e_o$) which occurs at each step as the optimum current level is approached. Automatic test equipment so arranged would determine with precision the change in current through the Zener diode required to produce zero error, and the resistor trimming would be so arranged as to effect such change in current.

FIG. 1 sets forth the actual resistance values of the thermistor 48 and the associated resistors 46 and 50 which have been determined to be appropriate for use with a commonly available class of Zener diodes. If Zeners having different characteristics are to be employed, the network resistor values should be changed correspondingly. The equation for determining the room temperature resistance of the thermistor is:

$$r = \frac{V_Z}{\Delta I_H}\,\frac{(n+1)}{nk}\,\frac{[(b-1)(n+a)-(1-a)(n+b)k]^2}{\{(b-1)(n+a)+(1-a)(n+b)\}[(n+1)\{a(b-1)-kb(1-a)\}\{(n+a)(b-1)-k(1-a)(n+b)\}]} \quad (1)$$

Figure 7:
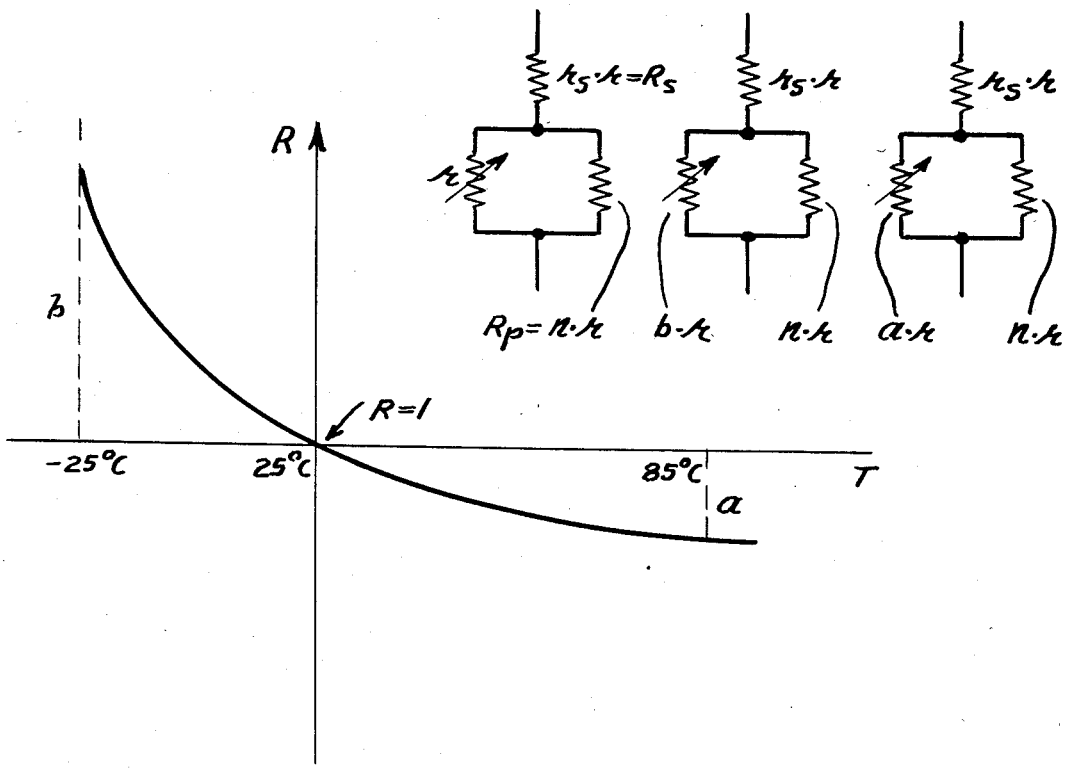
FIG. 7 is a graph illustrating thermistor characteristics.

FIG. 7 illustrates the thermistor characteristics, using a normalized scale having thermistor resistance R at room temperature of unity to simplify the relationships. The associated network diagrams show the circuit values at cold and hot temperatures.

In order to determine the value for "n" to be used in equation (1), the following relationship is employed:

$$\frac{(b-1)(n+a)}{(1-a)(n+b)} = \frac{k}{1-(1+k)\Delta R_H} \quad (2)$$

$\Delta R_H$ in turn is determined from the following relationship:

$$\frac{\Delta I_H}{I_o} = \frac{1-\Delta R_H}{\Delta R_H} \quad (3)$$

In the above equations, the following definitions apply:

r = Thermistor value a = Value of thermistor at hot temperature b = Value of thermistor at cold temperature k = $\Delta I_C/\Delta I_H$ (Zener characteristic determined by inspection)

n = Scale factor for the resistor in parallel $\Delta I_H$ = Current excursion of Zener at hot temperature (chosen arbitrarily)

$V_Z$ = Nominal Zener voltage at operating current $R_p$ = Parallel resistor value $R_s$ = Series resistor value $I_o$ = Nominal quiescent operating current $R_H$ = Resistance of thermistor network at hot temperature The descriptive material set forth hereinabove has at times referred to the voltage across the Zener diode (as in discussing the Zener temperature characteristics), and at other times has referred to the output ($V_0$) of the voltage reference (as when discussing the procedures used for trimming the IC chip). The Zener voltage $V_Z$ and the reference output $V_0$ are very nearly the same, and can be considered equal for many purposes. However, there will be slight differences between the two, as introduced for example by the intervening circuitry such as the operational amplifier 22. The final trimming operation is based on measurements made at the reference output, and consequently any variations in output which might be caused by the circuitry associated with the Zener are automatically compensated for, at least in large part, by the trimming sequence set forth hereinabove.

Although a specific preferred embodiment of this invention has been described hereinabove in detail, it is desired to emphasize that this has been for the purpose of illustrating the invention, and should not be considered as necessarily limitative of the invention, it being understood that many modifications can be made by those skilled in the art while still practicing the invention claimed herein. For example, various circuits can be developed for properly controlling the current through the Zener diode. Still other modifications will be evident to those skilled in the art.

What is claimed is:

1. A precision voltage reference comprising:

a Zener diode;

an output circuit connected to said Zener diode to produce an output voltage corresponding to a voltage across the diode; and a temperature-responsive circuit for selectively controlling a current through said Zener diode in accordance with changes in temperature so as to tend to maintain the output voltage unaffected by such changes in temperature.

2. Apparatus as claimed in claim 1, wherein said temperature-responsive circuit includes a temperature-sensitive resistor connected to said Zener diode.

3. Apparatus as claimed in claim 2, wherein said temperature-sensitive resistor comprises a thermistor.

4. Apparatus as claimed in claim 3, wherein said thermistor has a negative temperature coefficient, and is connected in parallel with said diode.

5. Apparatus as claimed in claim 4, including a fixed resistor connected in series with said thermistor.

6. Apparatus as claimed in claim 5, including a second fixed resistor connected in parallel with said thermistor.

7. Apparatus as claimed in claim 1, wherein said output circuit comprises an operational amplifier having its input circuit connected to receive an input voltage from said Zener diode.

8. Apparatus as claimed in claim 1, including compensation means coupled to said output circuit and at least substantially eliminating linear error drift characteristics in said output voltage.

9. Apparatus as claimed in claim 1, wherein a quiescent operating current through said Zener is selectively set at a value providing at least substantial elimination of linear error drift characteristics.

10. Apparatus as claimed in claim 1, wherein said temperature-responsive circuit is effective to temperature compensate the output for two temperatures different from room temperature.

11. Apparatus as claimed in claim 10, wherein one of said two temperatures is colder than room temperature and one is hotter than room temperature.

12. For use with a Zener-diode voltage reference wherein temperature-responsive means selectively controls the current through a Zener to provide temperature compensation of the reference output; a method of adjusting said voltage reference for optimum operation which includes the steps of:

operating said voltage reference at a Zener output current which is biased away from the optimum operating point;

making electrical measurements to determine an error voltage developed from operation at two different temperatures; and altering the Zener current in proportion to the ratio of the error voltage to the difference between the dynamic impedances at the two temperatures.

13. A method as claimed in claim 12, wherein electrical measurements are made to determine the slopes of the current-vs-voltage curves at the two temperatures, in order to determine said dynamic impedances.

14. A method as claimed in claim 12, wherein the alteration of current through said Zener is effected by trimming a resistor connected to said Zener.

15. A method as claimed in claim 14, wherein said resistor is connected in series with said Zener.

16. A method as claimed in claim 15, wherein said temperature responsive means comprises a negative-temperature-coefficient resistor connected in parallel with said Zener.

17. For use with a Zener-diode voltage reference wherein temperature-responsive means selectively controls a current through the Zener to provide temperature compensation of the reference output; a method of adjusting said voltage reference for optimum operation which includes the steps of:

operating said voltage reference at a Zener output current which is pre-determinedly biased away from the optimum operating point;

making electrical measurements to determine an error voltage developed from operation of the voltage reference at two different temperatures;

determining from said electrical measurements an appropriate change in the Zener current to approach the optimum operating point; and adjusting the Zener current in correspondence to said determination.

18. The method as claimed in claim 17, including the steps of repeating the electrical measurements after each adjustment of the Zener current, determining whether further adjustment is needed, and making such further adjustment determined to be needed until the error is reduced to a desired low level.

* * * * *